US006598377B2

(12) United States Patent
Takahashi

(10) Patent No.: US 6,598,377 B2
(45) Date of Patent: Jul. 29, 2003

(54) FILM FOLDING-UP AND GUIDING DEVICE OF FILLING AND PACKING MACHINE

(75) Inventor: Yoshimori Takahashi, Niigata (JP)

(73) Assignee: Nippon Seiki Co., Ltd., Niigata (JP)

( * ) Notice: Subject to any disclaimer, the term of this patent is extended or adjusted under 35 U.S.C. 154(b) by 24 days.

(21) Appl. No.: 09/959,344

(22) PCT Filed: Jan. 31, 2001

(86) PCT No.: PCT/JP01/00685

§ 371 (c)(1),
(2), (4) Date: Oct. 23, 2001

(87) PCT Pub. No.: WO01/64517

PCT Pub. Date: Sep. 7, 2001

(65) Prior Publication Data

US 2002/0157357 A1 Oct. 31, 2002

(30) Foreign Application Priority Data

Feb. 28, 2000 (JP) ..... 2000-055916

(51) Int. Cl.[7] ..... B65B 61/18; B65B 9/20

(52) U.S. Cl. ..... 53/550; 53/551; 53/374.4; 493/405; 493/439; 493/440; 493/443; 493/467

(58) Field of Search ..... 53/550, 551, 555, 53/374.4; 493/439, 405, 440, 467, 443

(56) References Cited

U.S. PATENT DOCUMENTS 4,050,361 A * 9/1977 Traise ..... 493/332
4,631,905 A * 12/1986 Maloney ..... 53/554
4,745,731 A * 5/1988 Talbott et al. ..... 53/451
5,186,707 A * 2/1993 Barta ..... 493/439
5,246,416 A * 9/1993 Demura et al. ..... 493/439
5,400,568 A * 3/1995 Kanemitsu et al. ..... 53/412
5,540,035 A * 7/1996 Plahm et al. ..... 53/451
5,713,186 A * 2/1998 Bruhn ..... 53/450
5,722,215 A * 3/1998 Yuyama ..... 53/374.4
5,822,949 A * 10/1998 Naoi ..... 53/55
5,862,652 A * 1/1999 Schoeler ..... 53/551
5,971,905 A * 10/1999 Fukuda ..... 493/3
6,237,308 B1 * 5/2001 Quintin et al. ..... 53/451
6,332,305 B1 * 12/2001 Takahashi ..... 53/551
6,397,557 B1 * 6/2002 Bassissi et al. ..... 53/51

FOREIGN PATENT DOCUMENTS

| | | |
|---|---|---|
| JP | 61-69521 | 4/1986 |
| JP | 5-65108 | 3/1993 |
| JP | 11-79112 | 3/1999 |

* cited by examiner

*Primary Examiner*—Rinaldi I. Rada
*Assistant Examiner*—Brian Nash
(74) *Attorney, Agent, or Firm*—McDermott, Will & Emery

(57) ABSTRACT

In a folding and guiding apparatus for use in a filling and packing machine, film F that is drawn out and guided from a film winding core and fed continuously is double-folded up along the longitudinal direction thereof, and pack-target material is filled and packed while the four sides of the double-folded film are sealed. A film guide member 12 for regulating and holding the outer surface portions of the folded portions of the double-folded film is provided between a film folding mechanism 4 and a longitudinal sealing mechanism 5 so as to be adjacent to the longitudinal sealing mechanism 5.

9 Claims, 6 Drawing Sheets

FILM FOLDING-UP AND GUIDING DEVICE OF FILLING AND PACKING MACHINE

BACKGROUND OF THE INVENTION

1. Field of the Invention

The present invention relates to a filling and packing machine by which a packing film extracted and guided from a film winding core and fed continuously is double-folded up along the longitudinal direction of the film and pack-target material is filled and packed while the four sides of the film thus folded up are sealed, and particularly a film folding and guiding apparatus for use in a filling and packing machine for feeding out a folded film to a predetermined position.

2. Description of the Related Art

A packing bag in which pack-target material such as liquid, powder or viscous material like sauce, soy sauce, mayonnaise or the like is filled and hermetically sealed is generally formed by sealing the four sides of a film in longitudinal and lateral directions.

One of filling and packing machines for filling and packing pack-target material while sealing the four sides of a film is disclosed in Japanese Laid-open Patent Application No. Sho-61-69521 or the like, for example. As disclosed in this publication, a pair of holding frames are provided at the side portion of the machine table of the filling and packing machine, and a film winding core around which a film is wound in the form of a roll is detachably and exchangeably supported by the holding frames. A film guide portion and a film folding portion are disposed at the upper portion of the machine table, and a longitudinal seal portion, a lateral seal portion and a cutter portion are disposed in this order from the upper side to the lower side of the front surface portion of the machine table.

According to the filling and packing machine disclosed in the above publication, the film is drawn out from the film winding core and guided through the film guide portion to the film folding portion. The film thus guided is double-folded up along the longitudinal direction thereof by the film folding portion, and both the side edges of the film is longitudinally sealed in a cylindrical form by the heated longitudinal seal portion. Thereafter, the film is laterally sealed in the lateral direction by the heated lateral seal portion to thereby form the bottom portion of a packing bag, and pack-target material such as liquid or the like is filled into the cylindrical film having the bottom portion by a filling nozzle of a filling machine. Thereafter, the cylindrical film is further fed and the open side thereof is laterally sealed by the heated lateral seal portion again to thereby seal the pack-target material. Thereafter, the middle portion of the laterally-sealed portion of the film is cut by the cutter portion, thereby achieving the four-side sealed packing bag, and the packing bag thus formed is fed by a conveyor or the like.

According to the conventional filling and packing machine as described above, the film is fed out while sealed by the longitudinal and lateral seal portions, and the speed of the sealing and packing work of the film can be increased by increasing the rotational speed of these seal portions. However, the film may be fed out while positionally displaced from a predetermined position due to irregular winding of the roll-shaped winding on the film winding core, variation of the tense of the film drawn out from the film winding core or the like. Therefore, if the film is fed from the film folding portion while the fold-up position of the film is deviated from a normal position, the longitudinal sealing position is displaced from a predetermined position, so that the sealing interval between both the side edges of the film by the longitudinal seal portion is dispersed, and in its turn, a sealing failure may occur.

SUMMARY OF THE INVENTION

Therefore, an object of the present invention is to provide a film folding and guiding machine for use in a filling and packing machine which can suppress the positional displacement of a fold-up packing film and feed the film to a predetermined position accurately.

In order to attain the above object, there is provided a film folding and guiding apparatus for use in a filling and packing machine, characterized by comprising: a film folding mechanism for double-folding a continuously-fed film drawn out and guided from a film winding core along the longitudinal direction of the film and is provided the upper portion side of a machine table of a filling and packing machine; a longitudinal sealing mechanism for longitudinally sealing at least both of right and left edge portions of the double-folded film which is folded up in a cylindrical form by a folding guide of the film folding mechanism; a lateral sealing mechanism that is provided below the longitudinal sealing mechanism and laterally seals the cylindrically-shaped film formed by the longitudinal sealing mechanism to form a bottom portion of a packing bag which will be formed; a filling mechanism for filling pack-target material into the cylindrically-shaped film having the bottom portion formed through the lateral sealing of the lateral sealing mechanism, a portion of the film which will serve as a bag open portion being laterally sealed by the lateral sealing mechanism while the film is fed, thereby forming a packing bag that is heat-sealed at the four sides thereof; a cutter mechanism for cutting a laterally-sealed portion of the packing bag which is sealed at the four sides thereof; and a film guide member that is located between the film folding mechanism and the longitudinal sealing mechanism so as to be adjacent to the longitudinal sealing mechanism, and holds and regulates the outer surface portions of the folded portions of the double-folded film, thereby suppressing the positional displacement of at least both the right and left edge portions of the double-folded film which is folded up and guided and accurately sealing both the edge portions of the film in a proper positional relationship.

According to the present invention, the tip portion of the folding guide provided to the film folding mechanism is disposed so as to be approximate to a longitudinal heat seal roll of the longitudinal sealing mechanism, and the film guide member is provided so as to confront the folding guide, whereby the film to be folded and guided is guided to the longitudinal heat seal roll position of the longitudinal sealing mechanism along the folding guide, drawn out and guided without any positional displacement in the lateral direction and then longitudinally sealed at a predetermined position.

Further, according to the present invention, the film guide member is urged against the folding guide under soft pressure through the folded portions of the double-folded film, whereby the film can be fed while a load acting on the feeding of the film in the lateral direction can be absorbed by the film guide member, and also the film can be held at a predetermined position without applying large force to the film to perform a stable film feeding operation.

DETAILED DESCRIPTION OF THE PREFERRED EMBODIMENTS

Figure 1:
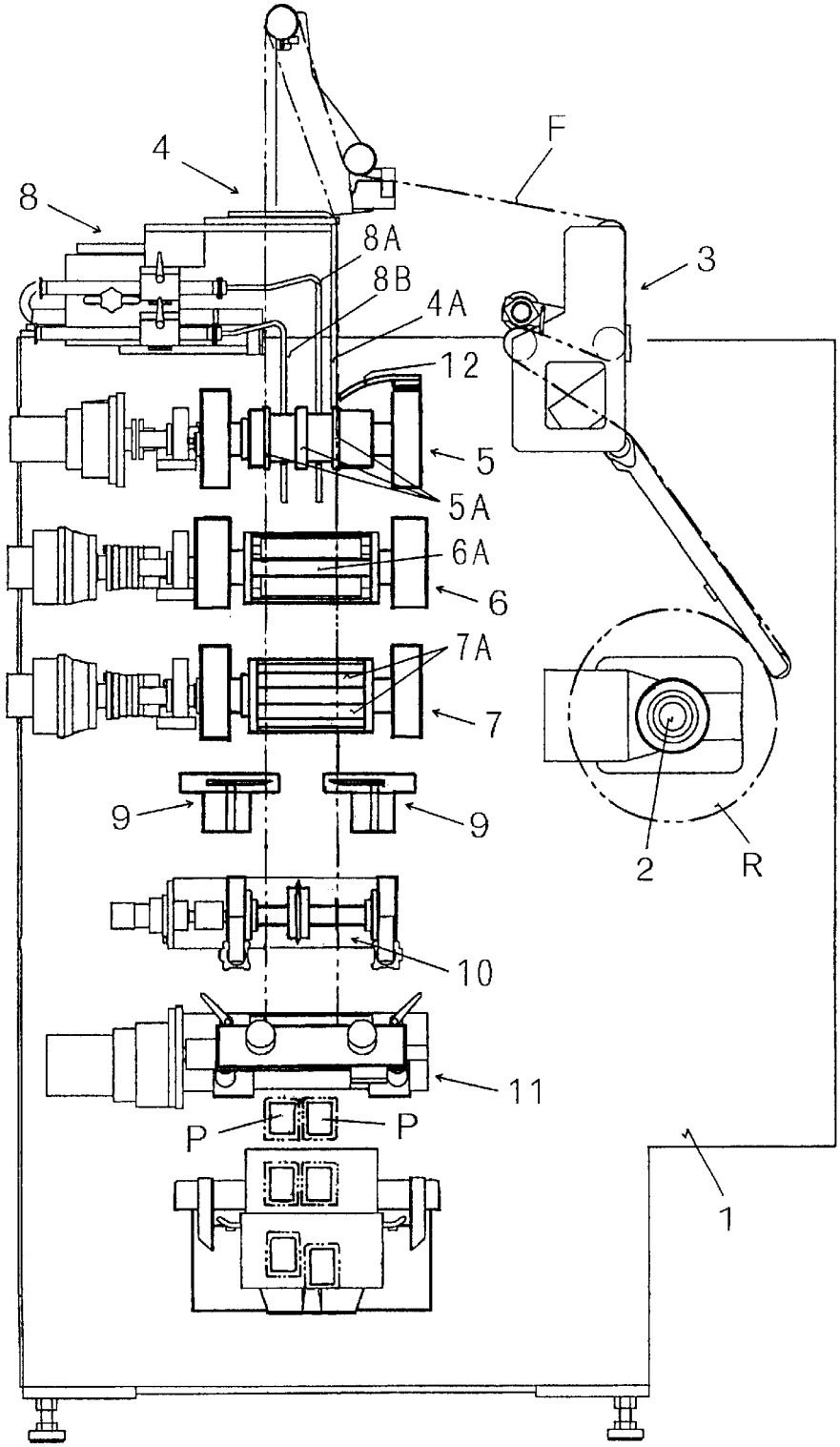
FIG. 1 is a front view showing the overall construction of a filling and packing machine according to a first embodiment of the present invention.

Preferred embodiments according to the present invention will be described hereunder with reference to the accompanying drawings.

A first embodiment according to the present invention will be described with reference to the accompanying drawings. The construction and operation of a filling and packing machine according to the present invention will be described with reference to FIGS. 1 to 4.

In FIGS. 1 to 4, reference numeral 1 represents a machine table. A holding frame 2 is provided at the side of the machine table 1, and a film winding core R around which film F is wound is detachably and exchangeably mounted on the holding frame 2.

The film F drawn out and guided from the film winding core R is temporarily drawn out and guided upwardly while predetermined tension is applied to the film F through a film guide mechanism 3, and then double-folded along the longitudinal direction of the film F by a folding guide 4A of a film folding mechanism 4 disposed at the upper portion of the machine table 1. Thereafter, the double-folded film F is drawn out and guided downwardly.

Figure 2:
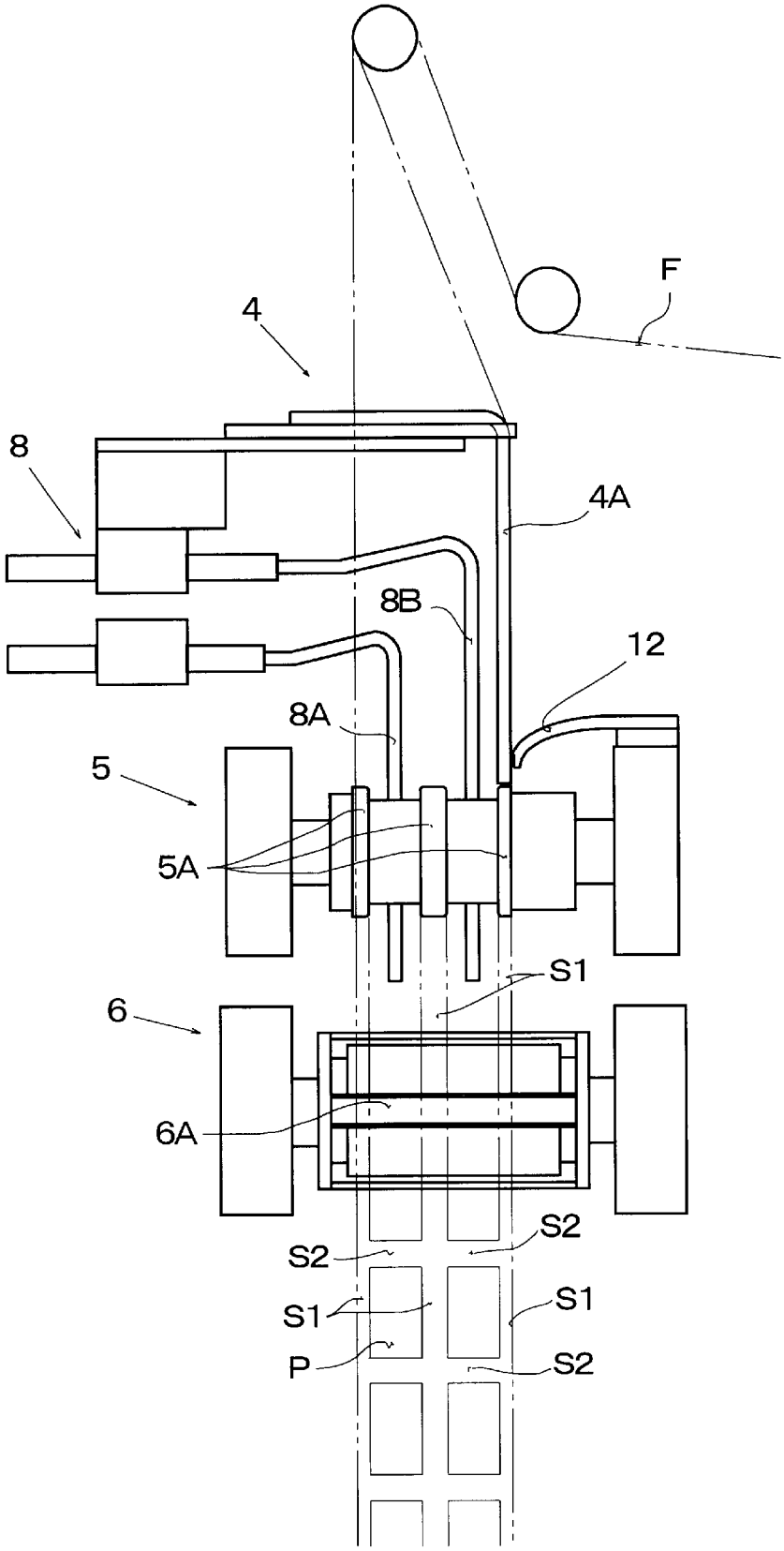
FIG. 2 is a front view mainly showing the main part of a film folding portion of the filling and packing machine.
Figure 3:
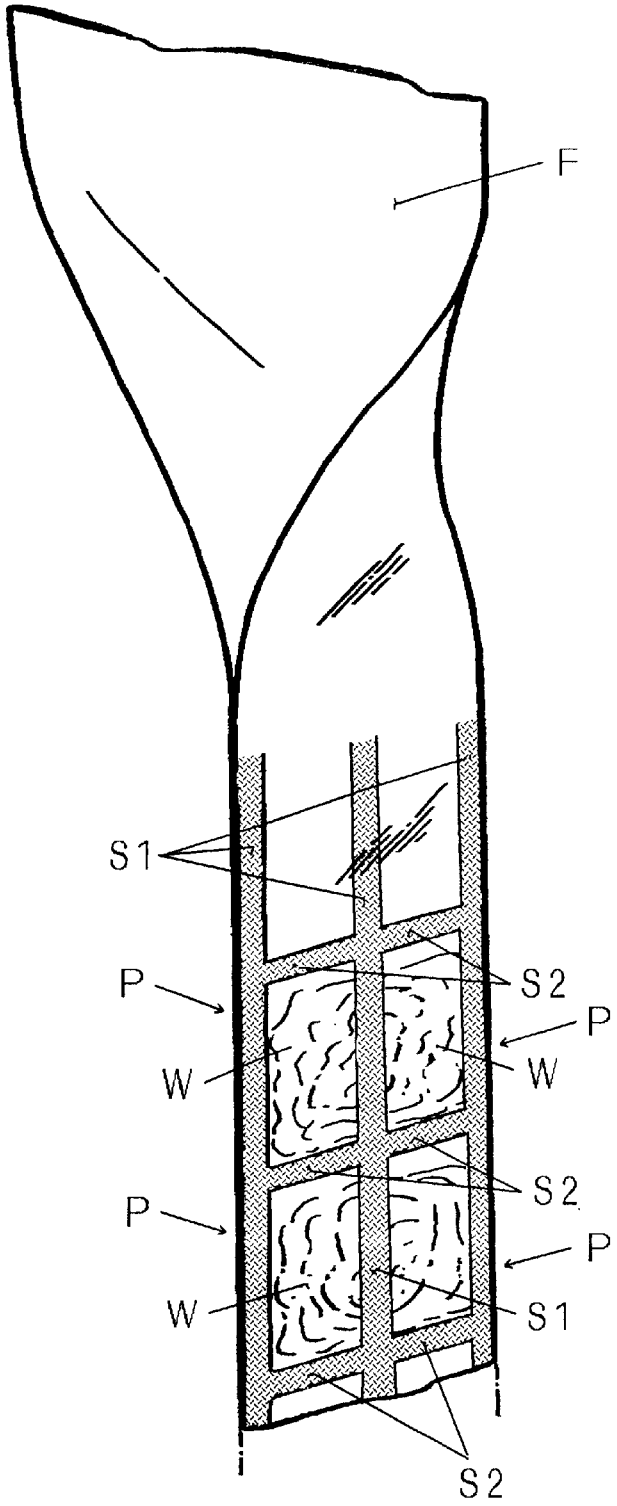
FIG. 3 is a diagram showing a packing style of a packing film formed by the filling and packing machine according to the first embodiment of the present invention.
Figure 4:
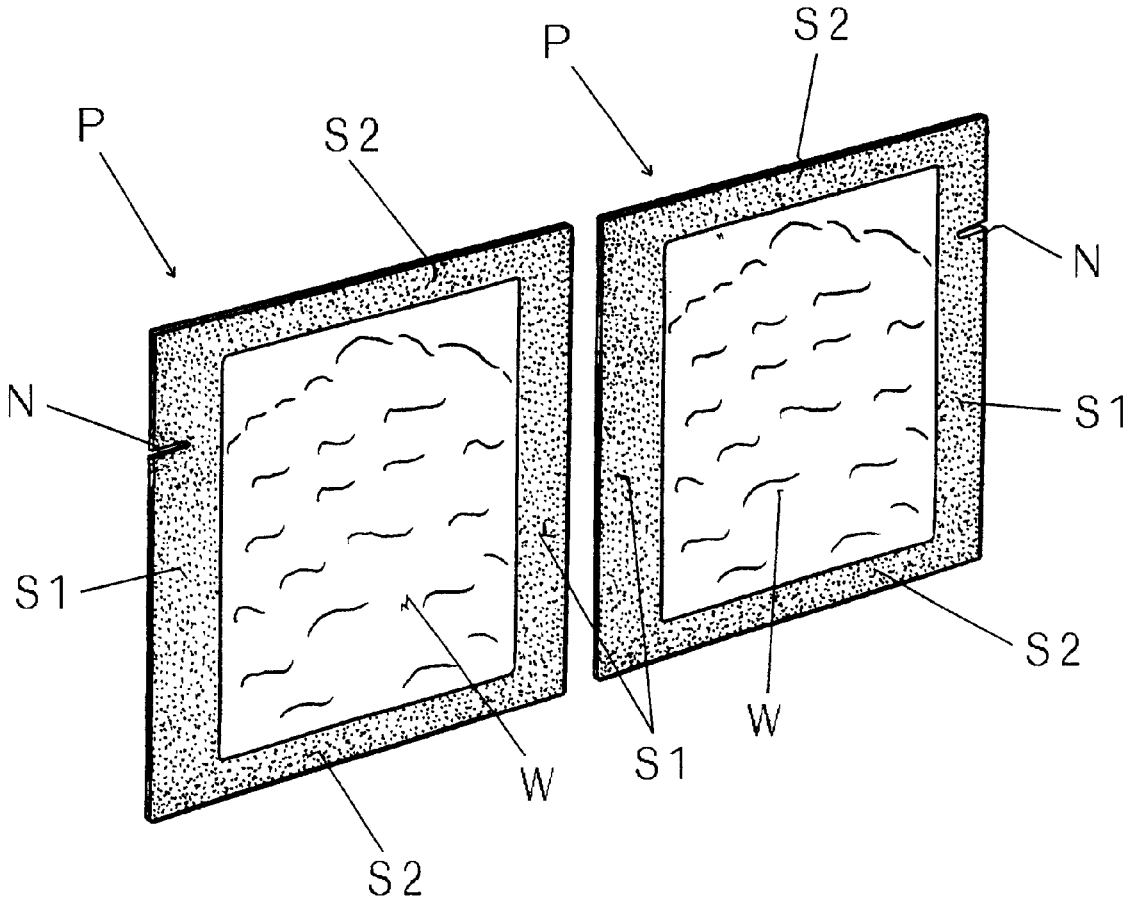
FIG. 4 is a perspective view showing a packing bag formed by the filling and packing machine according to the first embodiment of the present invention.

In this embodiment, the double-folded film F is drawn out and fed downwardly while each of the folded edge portion, the intermediate portion and the folded end portions (i.e., both the right and left edge portions and the intermediate portion of the film F as shown in FIG. 2) are longitudinally sealed by a set of longitudinal heat seal rolls 5A of a longitudinal sealing mechanism 5 to form a longitudinal seal portion S1, and then the film F is laterally heat-sealed by a first lateral sealing mechanism 6 and a second lateral sealing mechanism 7 located below the longitudinal mechanism 5 to form a lateral seal portion S2.

In this case, the film F is laterally heat-sealed at a predetermined interval in the lateral direction by a pair of lateral heat-seal rolls 6*a* of the first lateral sealing mechanism 6 to form a lateral seal portion S2. The laterally-sealed portion S2 of the film F forms the bottom portions of two cylindrical film portions which are juxtaposed with each other at the right and left sides and will serve as packing bags. Pack-target material W is filled into the cylindrical film portions having the bottom portions from filling nozzle portions 8A, 8B of a filling mechanism 8, and then the film F is fed. Thereafter, a portion of the film F which will serve as bag open portions is laterally heat-sealed by the lateral heat-seal rolls 6A of the first lateral sealing mechanism 6, and the pack-target material W is sealed by the lateral seal portion S2 formed through the lateral heat-sealing. The lateral seal portion S2 is pressed by a pair of lateral seal rolls 7A of a second lateral sealing mechanism 7 to hermetically seal the film F, so that the film F is heat-sealed at four sides thereof to form packing bags P. The packing bags P thus formed are successively continuously fed downwardly while arranged in a line.

In the filling and packing machine of this embodiment, opening notch forming mechanisms 9 each having a cut-in blade for forming an opening notch N are further disposed at the lower side of the second lateral sealing mechanism 7, and a slitter mechanism 10 having a separating cutter blade is disposed so as to confront the longitudinal seal portion S1 at the center position between the two packing bags P juxtaposed at the right and left sides is disposed at the lower side of the opening notch forming mechanisms 9. Further, a cutting mechanism 11 having a cutter blade for cutting out substantially the center portion of the lateral seal portion S2 between the upper and lower packing bags P arranged in a line and then feeding the packing bags P thus cut out is disposed at the lower side of the slitter mechanism 10.

The opening notch forming mechanisms 9 are located at both the end sides of the packing bags P arranged at the right and left sides, and each of them is equipped with a cut-in blade (not shown) for forming an opening notch N in each of the longitudinal seal portions S1 formed at both the end sides. Accordingly, an opening notch N is formed at a predetermined position of each of the longitudinal seal portions S1 at both the end sides of the continuously-fed packing bags P so as to extend in the depth direction of the longitudinal seal portion S1 of each packing bag P.

Further, a film guide member 12 for regulating and holding the outer surface portions of the folded portions of the double-folded film F is disposed between the film folding mechanism 4 and the longitudinal sealing mechanism 5 so as to be adjacent to the longitudinal sealing mechanism 5. In this embodiment, a plate-shaped member formed of synthetic resin material having flexibility is used as the film guide member 12.

The folding guide 4A equipped to the film folding mechanism 4 arranged at the upper portion of the machine table 1 is designed so as to be bent substantially in an L-shape, and the tip portion of the folding guide 4A is disposed in the vicinity of the longitudinal heat-seal roll 5A. The double-folded film F is downwardly drawn and guided along the longitudinal direction by the folding guide 4A.

In this embodiment, the tip side of the film guide member 12 is urged against the folding guide 4A under soft pressure through the folded portions of the double-folded film F.

In the filling and packing machine of the present invention thus constructed, the film F which is drawn out and guided from the film winding core R is temporarily drawn out and guided upwardly under predetermined tension through the film guide mechanism 3, double-folded along the longitudinal direction of the film F by the folding guide 4A of the film folding mechanism 4 disposed at the upper portion of the machine table 1, and then drawn out and guided downwardly. The double-folded film F thus fed downwardly is subjected to the longitudinal heat sealing by the set of longitudinal heat seal rolls 5A of the longitudinal sealing mechanism 5 so that each of the folded edge portion, the intermediate portion and the folded end portions is heat-sealed in the longitudinal direction to thereby form the longitudinal seal portions S1.

At this time, the film guide member 12 for regulating and holding the outer surface portions of the folded portions of the double-folded film F is disposed between the film folding mechanism 4 and the longitudinal sealing mechanism 5 so as to be adjacent to the longitudinal sealing mechanism 5, thereby suppressing the variation due to the positional displacement of both the right and left edge portions of the double-folded film F which is folded and guided, so that the longitudinal sealing of both the edge portions of the film F can be performed in the proper positional relationship. Further, the tip portion of the folding guide 4A equipped to the film folding mechanism 4 is disposed so as to be approximate to the longitudinal heat-seal roll 5A of the longitudinal sealing mechanism 5, and the film guide member 12 is disposed so as to confront the folding guide 4A, whereby the film F which is folded and guided can be guided to the position corresponding to the longitudinal heat-seal rolls 5A of the longitudinal sealing mechanism 5 along the folding guide 4A, and thus the longitudinal seals S1 can be formed at predetermined positions by drawing and guiding the film F without any positional displacement in the lateral direction.

In addition, in this embodiment, the film guide member 12 is urged against the folding guide 4A under soft pressure through the folded portions of the double-folded film F, so that the film F can be fed while the load acting on the feeding of the film F in the lateral direction can be absorbed by the film guide member 12, and also the film F can be stably fed by holding the film F at a predetermined position without applying any large force to the film F.

The four-side sealed packing bag P of this embodiment is formed as follows. One sheet of film F is drawn out and guided while it is folded halfway, and the folding end portion, the center portion of the folded film F and the folded end edges (i.e., both the right and left edge portions, the intermediate portion) are longitudinally heat-sealed in the longitudinal direction by the three longitudinal heat seal rolls 5A of the longitudinal sealing mechanism 5 to form cylindrical bags arranged in two lines. Thereafter, the cylindrical bags thus formed are sealed by the first lateral sealing mechanism 6 and the second lateral sealing mechanism 7 disposed below the longitudinal sealing mechanism 5 to form the lateral seal portions S2. Accordingly, two four-side sealed packing bags P are formed in juxtaposition with each other at the right and left sides, and the packing bags P are separated form each other by acting the slitter mechanism 10 having the separating cutter blade on the center longitudinal seal portion S1 between the packing bags P arranged at the right and left sides.

Figure 5:
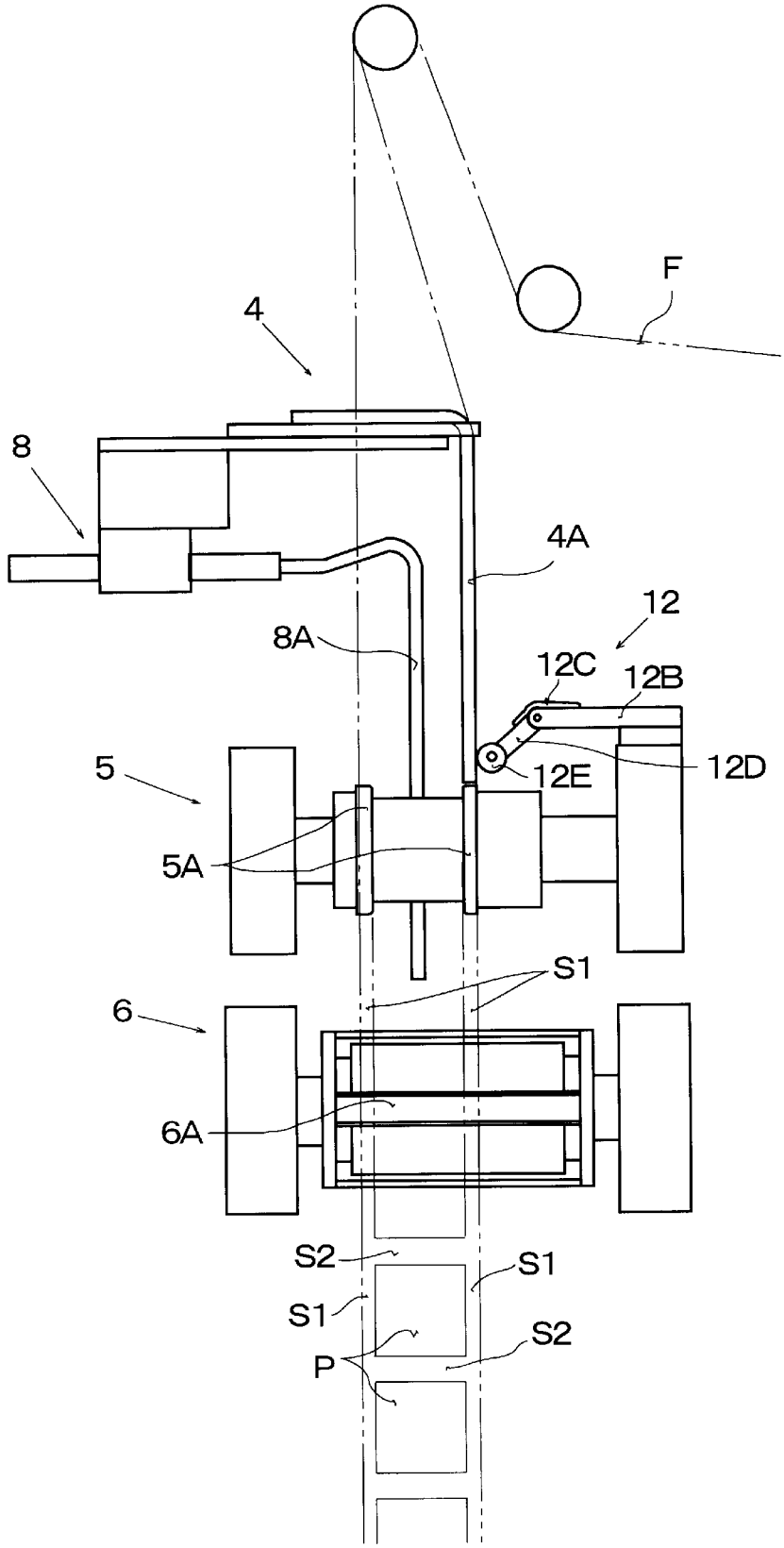
FIG. 5 is a front view mainly showing the main part of a film folding portion of a filling and packing machine according to a second embodiment of the present invention.
Figure 6:
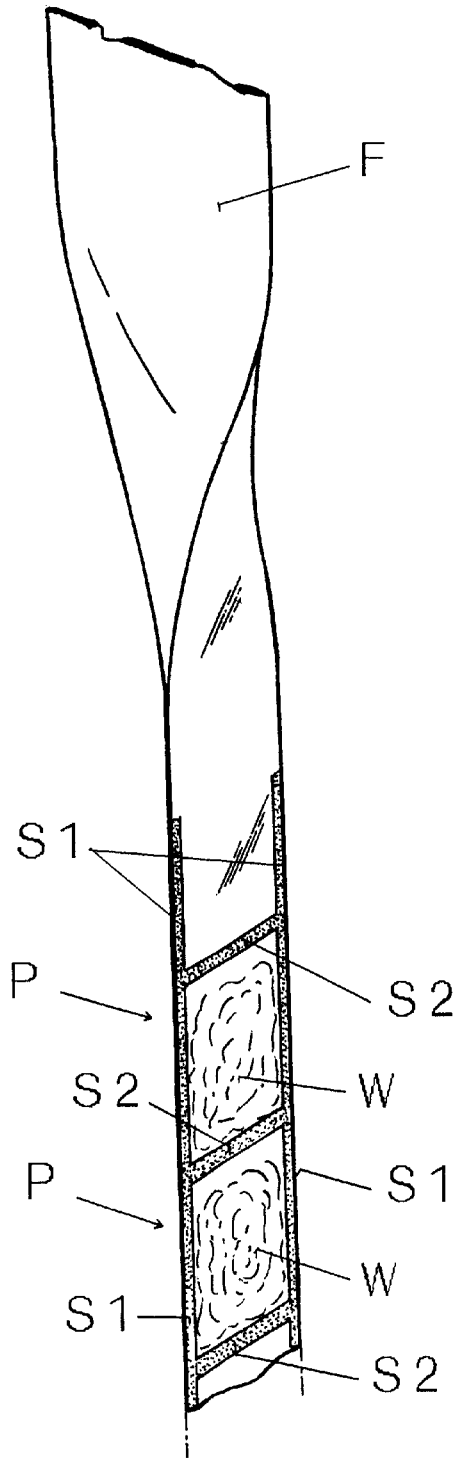
FIG. 6 is a diagram showing a packing style of a packing film formed by the filling and packing machine according to the second embodiment of the present invention.

FIGS. 5 and 6 show a second embodiment of the invention.

As in the case of the first embodiment described above, the film F which is drawn out and guided from the film winding core is temporarily upwardly drawn out and guided through the film guide mechanism 3, then double-folded along the longitudinal direction of the film F by the folding guide 4A of the film folding mechanism 4 disposed at the upper portion of the machine table 1, and then downwardly drawn and guided. In this embodiment, the double-folded film F is longitudinally heat-sealed at two portions at the folded edge portion and the folded end portions (both the right and left edge portions) in the longitudinal direction to form longitudinal seal portions S1 by a pair of longitudinal heat seal rolls 5A of the longitudinal sealing mechanism 5, and then laterally heat-sealed by the lateral sealing mechanism 6 disposed below the longitudinal sealing mechanism 5 to form the lateral portions S2, thereby forming packing bags P.

In the second embodiment, as the film guide member 12 that regulates and holds the outer surface portions of the folded portions of the double-folded film F and is disposed between the film folding mechanism 4 and the longitudinal sealing mechanism 5 so as to be adjacent to the longitudinal heat seal roll 5A of the longitudinal sealing mechanism 5, a fixing arm 12B is fixed to a suitable position of the machine table 1, and a movable arm 12D is urged against the folding guide 4A under soft pressure through a spring member 12C. A roller 12E is rotatably secured to the tip of the movable arm 12*d,* and the roller 12E of the film guide member 12 is urged under soft pressure against the folded portions of the double-folded film F.

Accordingly, substantially the same effect as the first embodiment can be attained. In this embodiment, as means of urging the film guide member 12 against the folding guide 4A under soft pressure through the folded portions of the double-folded film F, the movable arm 12D having the roller 12E at the tip thereof is pressed against film F side through the spring member 12C. Therefore, the film F can be prevented from being floated while pressed and held at a predetermined position by absorbing the load acting on the feeding of the film F in the lateral direction with the spring member 12C without applying any large force to the film F. In addition, since the roller 12E can rotate interlockingly with the feeding of the film F, the film F can be supplied excellently.

The present invention is not limited to the above embodiments, and various modifications may be made without departing from the subject matter of the present invention. For example, in the above embodiments, the film guide member 12 for urging the folding guide 4A through the folded portions of the double-folded film F under soft pressure is formed of a plate-shaped member of synthetic resin having flexibility, or the movable arm 12D having the roller 12E urges the folding guide 4A through the spring member 12C. However, a flexible leaf spring may be used. Further, a rod-shaped member is bent to form the folding guide 4A of the film folding mechanism 4. However, a thin plate that is folded in a frame shape or an arcuate shape may be used. The shape, dimension, etc. of the film guide member 12, the film folding mechanism 4, etc. may be set in consideration of the positional relationship with the longitudinal sealing mechanism 5.

As described above, the present invention relates to a film folding and guiding apparatus for use in a filling and packing machine in which packing film drawn out and guided from the film winding core and continuously fed is double-folded along the longitudinal direction of the film, and pack-target material is filled and packed while the four sides of the double-folded film are sealed, and particularly the present invention is suitably used for a film folding guide apparatus in a filling and packing machine for feeding out folded film to a predetermined position in the longitudinal direction.

What is claimed is:

1. A film folding and guiding apparatus for use in a filling and packing machine, characterized by comprising:

a film folding mechanism for folding a continuously-fed film drawn out and guided from a film winding core along the longitudinal direction of the film;

a longitudinal sealing mechanism for longitudinally sealing longitudinal edge portions of the folded film, which is folded by a folding guide of said film folding mechanism;

a lateral sealing mechanism provided downstream of said longitudinal sealing mechanism configured to laterally seal the folded film following sealing by said longitudinal sealing mechanism to form a bottom portion of a packing bag;

a filling mechanism for filling pack-target material into said bottom portion of the packing bag;

a cutter mechanism for cutting a laterally-sealed portion of the packing bag, which is sealed at the four sides thereof, while the film is fed; and a film guide member that is located between said film folding mechanism and said longitudinal sealing mechanism and adjacent to said longitudinal sealing mechanism, said film guide member configured to guide outer surface portions of a longitudinal edge of said folded film to suppress a positional displacement of said longitudinal edge of the folded film so as to permit accurate sealing Qf both the edge portions of the film in a proper positional relationship, wherein said film guide member is urged against said folding guide through the fold of the folded film.

2. The film folding and guiding apparatus as claimed in claim 1, wherein the tip portion of said folding guide provided to said film folding mechanism is disposed so as to be approximate to a longitudinal heat seal roll of said longitudinal sealing mechanism, and said film guide member is provided so as to confront the folding guide.

3. The film folding and guiding apparatus as claimed in claim 1, wherein said film guide member is urged against said folding guide along a center-line of the fold of the folded film.

4. The film folding and guiding apparatus as claimed in claim 1, wherein said film guide member comprises a roller resiliently biased against said film.

5. The film folding and guiding apparatus as claimed in claim 4, wherein said resilient bias is provided by a spring.

6. The film folding and guiding apparatus as claimed in claim 1, wherein said film guide member comprises a plate member.

7. The film folding and guiding apparatus as claimed in claim 6, wherein said plate member comprises a resilient resin.

8. The film folding and guiding apparatus as claimed in claim 1, wherein said cutter mechanism is configured to cut through substantially a center portion of said laterally-sealed portion of the packing bag.

9. The film folding and guiding apparatus as claimed in claim 8, wherein said cutter mechanism further comprises a separating cutter blade configured to cut through a longitudinal seal portion.

* * * * *